United States Patent [19]

Engle

[11] Patent Number: 5,050,589

[45] Date of Patent: Sep. 24, 1991

[54] ISOKINETIC KNEE TABLE

[76] Inventor: Robert P. Engle, 1150 Berkshire Blvd., Wyomissing, Pa. 18854

[21] Appl. No.: 599,280

[22] Filed: Oct. 10, 1990

Related U.S. Application Data

[63] Continuation of Ser. No. 559,402, Jul. 26, 1990, abandoned, which is a continuation of Ser. No. 148,064, Jan. 25, 1988, abandoned.

[51] Int. Cl.[5] ..... A61H 1/02

[52] U.S. Cl. ..... 128/25 R; 128/71; 272/144

[58] Field of Search ..... 128/25 R, 70, 75, 71, 128/72, 73, 74; 272/143, 144, 145

[56] References Cited

U.S. PATENT DOCUMENTS

| | | | |
|---|---|---|---|
| D. 219,745 | 1/1971 | Windscheffel | 272/144 |
| 2,152,431 | 3/1939 | Jensen | 128/74 |
| 2,910,061 | 10/1959 | Rabjohn | 128/70 |
| 3,075,518 | 1/1963 | Sellner | 128/74 |
| 3,315,666 | 4/1967 | Sellner | 272/144 |
| 3,378,259 | 4/1968 | Kupchinski | 272/144 |
| 3,489,142 | 1/1970 | Golay | 128/71 |
| 3,761,081 | 9/1973 | Simmons | 272/144 |
| 4,157,089 | 6/1979 | Loughrey | 128/74 |
| 4,266,537 | 5/1981 | Bonin | 128/75 |
| 4,489,713 | 12/1984 | Lateuser | 128/75 |
| 4,579,109 | 4/1986 | Lundblad | 128/71 |
| 4,601,468 | 7/1986 | Bond et al. | 128/25 R X |
| 4,867,142 | 9/1989 | Jones | 128/75 X |
| 4,905,676 | 3/1990 | Bond et al. | 128/25 R |

OTHER PUBLICATIONS

"Isolated-Joint Testing & Exercise . . . ", A Handbook for Using Cybex® II and the U.B.X.T.

Operations Manual for the Lido Isokinetic Rehabilitation System, Loredan Biomedical, Inc.

*Primary Examiner*—Edgar S. Burr

*Assistant Examiner*—Moshe I. Cohen

*Attorney, Agent, or Firm*—Lucas & Just

[57] ABSTRACT

An apparatus and method for performing extension and flexion of a knee joint wherein the patient is in a prone position on an inverted V-shaped table is disclosed. The inverted V-shaped table can be adjustable.

9 Claims, 3 Drawing Sheets

ISOKINETIC KNEE TABLE

This is a continuation of application Ser. No. 559,402 filed July 26, 1990, now abandoned, which is a continuation of Ser. No. 148,064 1/25/88, now abandoned.

This invention relates to an isokinetic rehabilitation machine and, more specifically, to a table for use with an isokinetic rehabilitation machine for flexion movement and extension movement of a human knee. A method for using the device of the present invention is also disclosed.

Isokinetic rehabilitation machines are conventional apparatuses used for testing the strength of various muscles in the human body and for rehabilitation and strengthening of muscles in the human body. Typically, by isolating a joint and providing mechanical resistance while the patient is stationary, the isokinetic machine is able to test and strengthen the muscles around a joint. Modern isokinetic rehabilitation machines have been designed to perform at a constant speed throughout the range of motion such that as the muscle exerts a force during extension and flexion movements, the muscle encounters a variable force exerted by the patient. The force varies so that the muscle operates at a constant speed. Thus, regardless of the muscular force exerted by the patient, the speed of movement is controlled so that it does not exceed a predetermined speed. The speed is predetermined prior to the patient being strapped to the machine. The resistance provided by the isokinetic rehabilitation machine is inversely proportional to the force exerted by the muscles. Additionally modern isokinetic rehabilitation machines are equipped with a tracking system which records the progress of the patient while moving through extensions and flexions. Conventional isokinetic rehabilitation machines are sold under the name CYBEX manufactured by Lumex Inc. and under the name LIDO manufactured by Loredan Biomedical Inc.

Rehabilitation of the knee joint with isokinetic rehabilitation machines up to now has been limited to having the patient positioned in a sitting position. In order to work the knee the patient extends the knee forward against gravity and flexes the knee back with the aid of gravity. The quadriceps work against gravity in extending the knee while the hamstring muscles work with the aid of gravity in flexing the knee.

The present invention relates to a knee flexion/extension table for use with an isokinetic rehabilitation machine which allows the quadriceps to work with the aid of gravity and with the hamstrings to work against gravity. Thus, the knee in flexion movements work against gravity while the knee movements in extension work with the aid of gravity. This is a great improvement with respect to exercising and rehabilitating injured and/or weak knees.

Broadly, the present invention comprises an inverted V-shaped table upon which the patient is positioned in a prone position while the front of the knee rests against the front of the table. The isokinetic rehabilitation machine is then strapped to the area of the leg below the knee and the patient performs flexion movements against the force of gravity while the extension movements are performed with the aid of gravity. In this way less strain is placed upon the quadriceps of the patient. These and other aspects of the present invention may be further understood from the following detailed description:

Figure 1:
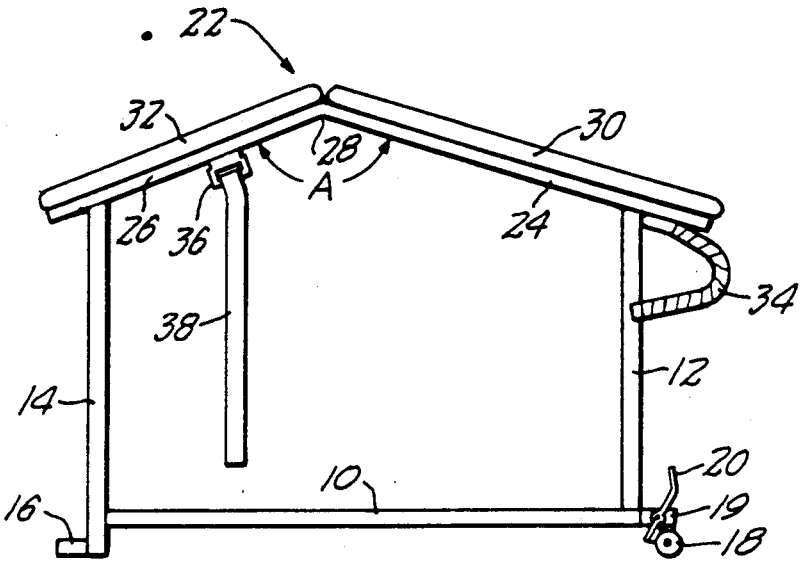
FIG. 1 illustrates a side view of a preferred inverted V-shaped table of the present invention.
Figure 3:
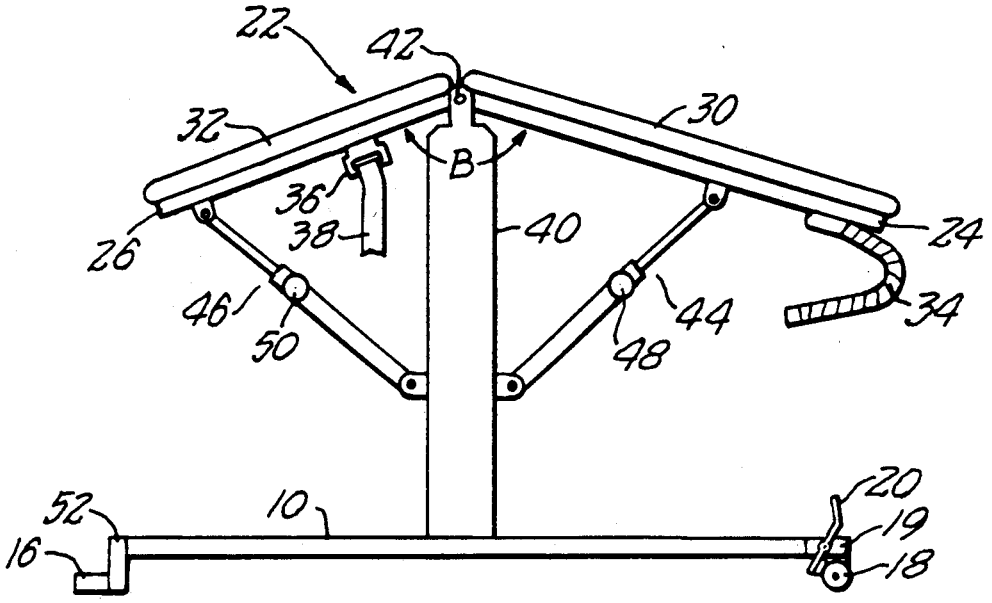
FIG. 3 illustrates another preferred embodiment of the inverted V-shaped table of the present invention having an adjustable angle.
Figure 6:
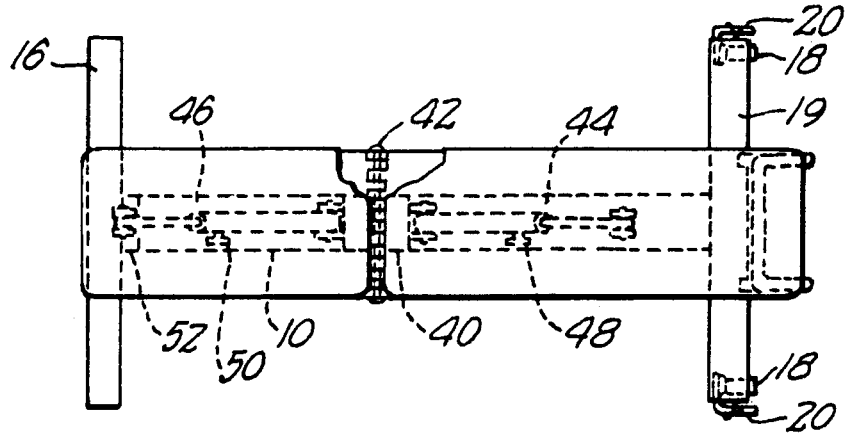
Figure 7:
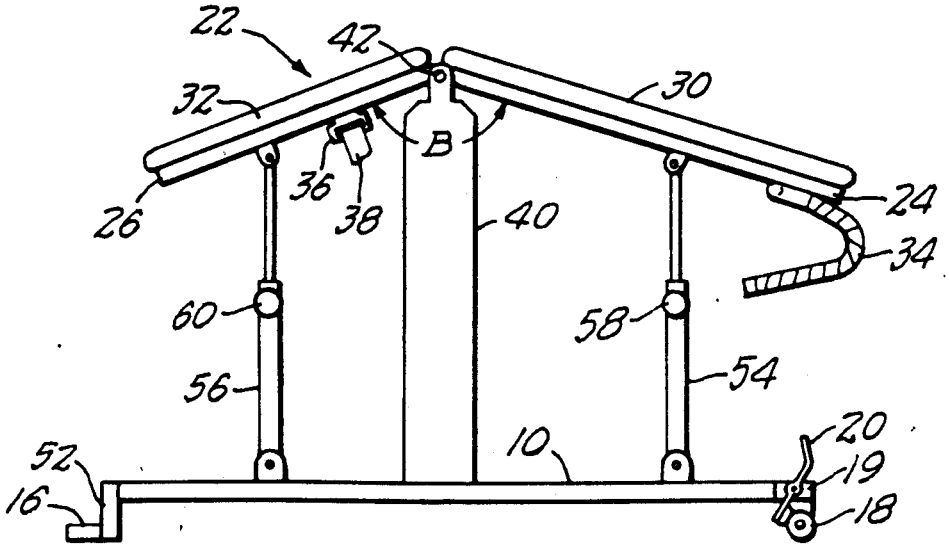

FIG. 6 is a top view of the adjustable inverted V-shaped table of FIG. 3; and FIG. 7 is still yet another preferred embodiment of the adjustable inverted V-shaped table of the present invention. Turning now to FIG. 1, the inverted V-shaped table of the present invention is shown with base 10 from which uprights 12 and 14 extend normally upwards. Base 10 has foot 16 which rests on the floor and wheel 18 which also rests on the floor. Wheel 18 is mounted on extension 19 of base 10. Base 10 is provided with locking means 20 for locking wheel 18 and preventing the inverted V-shaped table from moving. Inverted V-shaped table 22 is made up of metal plate 24 and metal plate 26 which are connected at 28. Plates 24 and 26 are provided with cushioning 30 and 32 respectively. Uprights 12 and 14 are fixed to metal plates 24 and 26 respectively. Metal plate 24 is provided with handles 34 which allow the patient to brace himself during flexion and extension movements. Attachement means 36 allows strap 38 to be attached to metal plate 26. The purpose of strap 38 is to allow the part of the leg above the knee to be secured to the table. Angle A of FIG. 1 is the angle between the two metal plates. Metal plate 24 is fixed to metal plate 26 such that angle A is constant. Angle A is preferably between about 130° to 150° and good results have been obtained with angle A of about 140°.

Figure 2:
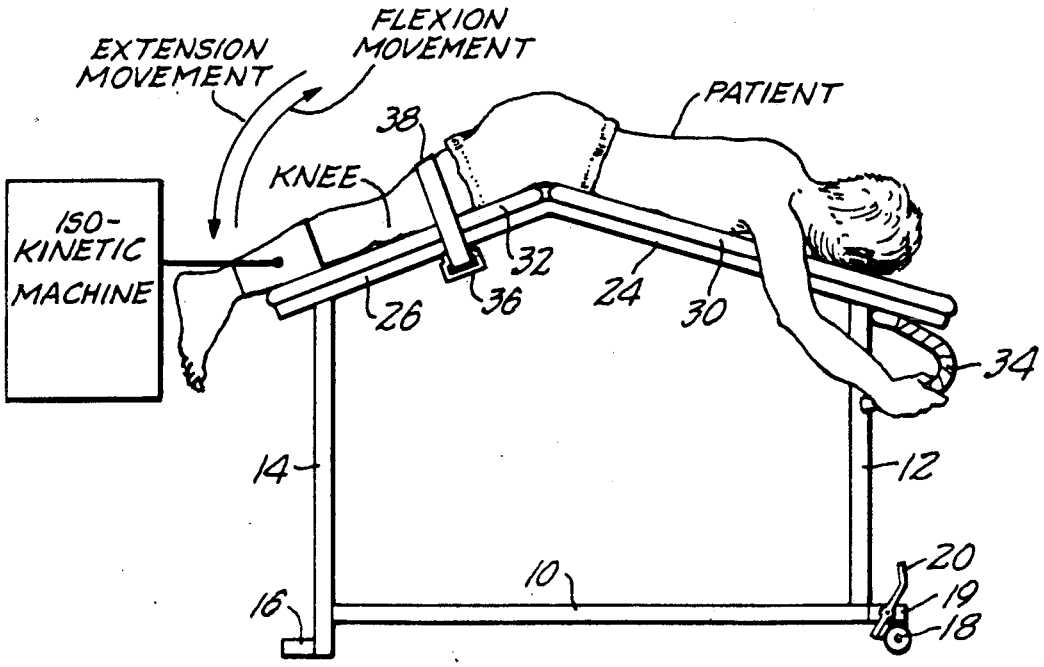
FIG. 2 illustrates a patient lying in the prone position and connected to an isokinetic rehabilitation machine on the inverted V-shaped table of FIG. 1.

FIG. 2 illustrates the inverted table of FIG. 1 with a patient positioned thereon. As is apparent, the patient is placed in the prone position having his hips positioned over 28. The patient is gripping handles 34 while the thigh portion of the patient's leg has been strapped to the table by means of strap 38. An isokinetic rehabilitation machine has been attached to the patient's leg below the knee. As is evident from FIG. 2 the table functions as a means to prevent the patient's leg from extending farther than that which is shown during extension movement. When the patient performs flexion movements, the hamstrings work against the force of gravity to raise the lower part of the leg towards the rump of the patient and the quadriceps of the patient are employed to perform extension movements to lower the leg back to the table. Such movement by the patient provides less strain on the quadriceps because during the extension motion the patient is aided by the weight of the lower leg in extension.

Turning now to FIG. 3, base 10 is provided with center pillar 40 upon which hinge 42 has been fixed. Hinge 42 is likewise affixed to metal plates 24 and 26. Inverted table 22 is adjustable by means of hinge 42 and telescoping tubes 44 and 46. Telescoping tubes 44 and 46 have locking pins 48 and 50, respectively, for fixing the length of telescoping tubes 44 and 46. By adjusting telescoping tubes 44 and 46 and allowing metal plates 24 and 26 to rotate about hinged 42 inverted table 22 is adjusted. Telescoping tube 44 is affixed at one end to plate 24 and at the other end to pillar 40. Telescoping tube 46 is affixed at one end to plate 26 and at the other end to pillar 40. Angle B varies depending on the adjustment of the telescoping tubes 44 and 46.

Figure 4:
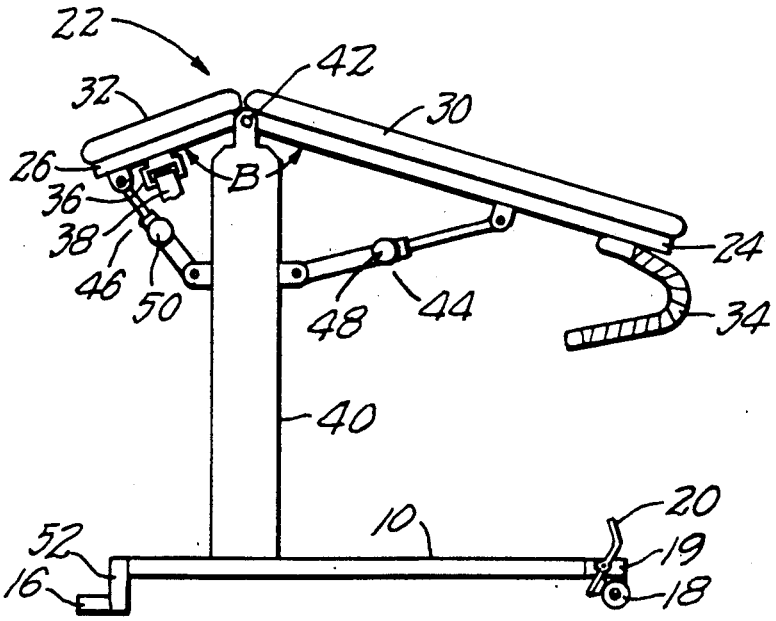
FIG. 4 illustrates yet another preferred embodiment of the inverted V-shaped table of the present invention having an adjustable angle and having a short table for the lower half of the patient's body.

FIG. 4 is an alternative embodiment of inverted table shown in FIG. 3. Inverted table 22 is shown with a shorter plate 26 such that the knee of the patient hangs over plate 26. It can be appreciated by one of skill in the art that the inverted table as shown in FIG. 4 does not provide a means to stop the lower leg when the leg is fully extended as the table shown in FIGS. 1-3.

Figure 5:
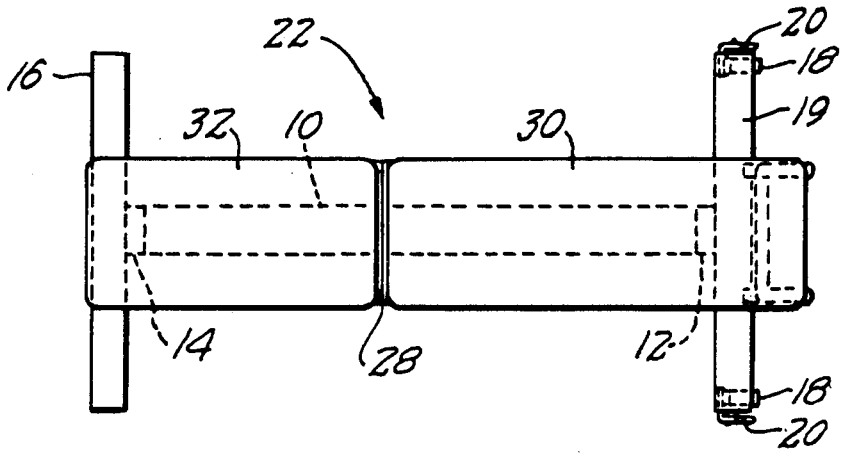
FIG. 5 is a top view of the inverted V-shaped table of FIG. 1.

Turning now to FIG. 5, FIG. 5 is a top view of the inverted table of FIG. 1. FIG. 5 shows foot 16 extending on either side of the table 22 and support bar 19 also extending on either side of table 22. Wheels 18 and locking means 20 are attached to support bar 19.

FIG. 6 is a top view of the inverted table of the present invention of FIG. 3. Again, it can be seen that foot 16 and support bar 19 extends past each side of the inverted table 22.

FIG. 7 is yet another preferred embodiment of the present invention. In FIG. 7 telescoping tubes 54 and 56 are affixed respectively to plates 24 and 26 at one end thereof and affixed to said base at their other end. As with the inverted V-shaped table of FIG. 3, angle B is variable by means of telescoping tubes 54 and 56. Telescoping tubes 54 and 56 have handles 58 and 60, respectively, for locking telescoping tubes 54 and 56 into a predetermined position.

With respect to telescoping tubes 44, 46, 54 and 56, it will be recognized by one of skill in the art that one of the pairs of telescoping tubes can be permanently set such that, for example, in FIG. 3 plate 26 will always make the same angle with respect to support member 40 and telescoping tube 44 will be variable thereby varying the angle between plate 24 and support bar 40 and plate 24 and plate 26.

It will be understood that the claims are not limited to the preferred embodiments of the present invention herein chosen for purposes of illustration, and that the claims are intended to cover all changes and modifications of the preferred embodiments of the present invention which do not constitute a departure from the spirit and scope of the present invention.

What is claimed is:

1. A knee rehabilitation system comprising:

(1) an isokinetic rehabilitation machine for extension and flexion of muscles around a knee joint of a patient, said machine having an arm on which there is a means for attaching a portion of a leg below the knee joint of the patient to said arm of said machine; and (2) a patient support means for positioning said patient is a prone position, said support means comprising:

a) a base;

b) a support member extending upward from said base one end of said support member affixed to said base;

c) an inverted V-shaped table affixed to the other end of said support member, said inverted V-shaped table comprises:

(i) a first support platform connected to a second support platform, said first support platform forming an acute angle with said second support platform and said acute angle remaining constant during extension and flexion of muscles around the knee joint by said patient;

(ii) a handle affixed to said first support platform for grasping by hands of said patient when said patient is in a prone position on said inverted V-shaped table and (iii) strap means affixed to said second support platform for holding a portion of the leg above the knee joint of said patient securely against the second support platform such that when the portion of the leg below the knee joint is attached to said arm of the machine, the hamstring muscles in the leg of the patient that is attached to the arm of the machine and held against the second support platform work against gravity during flexion movement and the quadriceps work with gravity during extension movement.

2. The system of claim 1 wherein said first support platform is connected to said second platform such that the angle between said first and second support platform is fixed.

3. The system of claim 2 wherein said support member comprises at least two uprights, said first upright permanently affixed at one end to one end of said base and the other end of said first upright permanently affixed to said first support platform; and a second upright, said second upright permanently affixed at one end to the other end of said base and the other end of said upright permanently affixed to said second support platform.

4. The system of claim 1 wherein said first platform is connected to said second platform by a hinge such that the angle between the first and second support platform is adjustable.

5. The system of claim 4 further comprising a hinge which is affixed to said first support platform, said second support platform and said support member; and telescoping means attached at one end to said base and at another end to said inverted V-shaped table such that the angle between said first support platform and said second support platform can be adjusted.

6. The system of claim 5 wherein said telescoping means comprises a first and a second telescoping tube and each of said telescoping tubes has a means to lock said telescoping tubes in a fixed length, one end of said first telescoping tube attached to said first support platform and another end of said first telescoping tube attached to said support member, one end of said second telescoping means attached to said second support platform and another end of said telescoping tube attached to said support member.

7. The system of claim 4 further comprising telescoping means attached at one end to said support member and at another end to said inverted V-shaped table such that the angle between said first support platform and said second support platform can be varied.

8. The system of claim 7 wherein said telescoping means comprises a first telescoping tube affixed at one end to one side of said support member and at the other end to said first support platform; and a second telescoping tube affixed at one end to the other side of said support member and at the other end to said second support platform.

9. A method for testing and/or strengthening a knee joint with an isokinetic rehabilitation machine comprising:

a) positioning a patient in a prone position on an inverted V-shaped table;
b) providing said patient with a handle to grip;
c) strapping a portion of a leg above the knee joint of said patient to said inverted V-shaped table;
d) connecting a portion of the leg below the knee joint of said patient to an isokinetic rehabilitation machine which has been preset for extension and flexion of a knee joint; and
e) having the patient move said knee joint in extension and flexion movements.

* * * * *

UNITED STATES PATENT AND TRADEMARK OFFICE

CERTIFICATE OF CORRECTION

PATENT NO. : 5,050,589

DATED : September 24, 1991

INVENTOR(S) : Robert P. Engle

It is certified that error appears in the above-identified patent and that said Letters Patent is hereby corrected as shown below:

Column 2, line 33, change "Attachement" to --Attachment--.

Column 3, line 1, change "hinged" to --hinge--.

Column 3, line 56, change "is" to --in--.

Column 4, line 6, after "table" insert --;--.

Signed and Sealed this

Twenty-third Day of February, 1993

*Attest:*

STEPHEN G. KUNIN

*Attesting Officer*

*Acting Commissioner of Patents and Trademarks*